US005501825A

United States Patent [19]

Jodelet

[11] Patent Number: 5,501,825

[45] Date of Patent: Mar. 26, 1996

[54] PROCESS FOR THE MANUFACTURE OF A SHAPED SKI

[75] Inventor: François Jodelet, Voiron, France

[73] Assignee: Skis Rossignol SAS, France

[21] Appl. No.: 300,720

[22] Filed: Sep. 2, 1994

[30] Foreign Application Priority Data

Sep. 7, 1993 [FR] France ..... 93 10831

[51] Int. Cl.[6] ..... B29C 44/06; B29C 44/12

[52] U.S. Cl. ..... 264/46.5; 264/46.7; 264/257; 264/258; 280/610

[58] Field of Search ..... 264/46.5, 46.6, 264/46.7, 258, 257; 280/610

[56] References Cited

U.S. PATENT DOCUMENTS

| | | | |
|---|---|---|---|
| 3,928,106 | 12/1975 | Molnar | 280/610 |
| 4,044,083 | 8/1977 | Howe et al. | 264/46.7 |
| 4,250,585 | 2/1981 | Theriault et al. | 264/46.7 |
| 4,259,274 | 3/1981 | Tiitola | 264/46.5 |
| 4,556,375 | 12/1985 | Hancock | 264/46.7 |
| 4,590,023 | 5/1986 | Hayashi et al. | 264/46.5 |
| 4,681,725 | 7/1987 | Maruyama | 264/46.6 |
| 4,706,985 | 11/1987 | Meatto | 280/610 |
| 4,711,462 | 12/1987 | Hayashi et al. | 264/46.7 |
| 4,725,070 | 2/1988 | Maruyama . | |
| 5,183,618 | 2/1993 | Pascal . | |
| 5,186,777 | 2/1993 | Perenon et al. | 264/46.5 |
| 5,230,844 | 7/1993 | Macaire et al. | 264/46.5 |
| 5,273,696 | 12/1993 | Cazaillon et al. | 264/46.7 |
| 5,288,442 | 2/1994 | Bauvois | 264/46.7 |
| 5,294,139 | 3/1994 | Cazaillon et al. | 264/46.7 |
| 5,333,889 | 8/1994 | Piegay et al. | 280/610 |

FOREIGN PATENT DOCUMENTS

| | | | |
|---|---|---|---|
| 0294299 | 12/1988 | European Pat. Off. | 280/610 |
| 0430824 | 5/1991 | European Pat. Off. . | |
| 0428885 | 5/1991 | European Pat. Off. . | |
| 0526353 | 3/1993 | European Pat. Off. . | |
| 2611519 | 6/1988 | France . | |
| 2620628 | 11/1989 | France . | |
| 2679820 | 5/1993 | France . | |
| 3512267 | 10/1986 | Germany | 264/46.6 |

*Primary Examiner*—Allan R. Kuhns
*Attorney, Agent, or Firm*—Harris Beach & Wilcox

[57] ABSTRACT

Process for the manufacture of a shaped ski in a single step, which includes:

in laying down, in the bottom of a mold, at least one lower reinforcing layer (13, 14);

in positioning, on this lower assembly (10), an upper reinforcing layer (22) composed of mechanization elements;

in placing, on this upper reinforcing layer (22), a protective and decorative layer (21);

in closing the cover of the mold;

in injecting, between the lower assembly (10) and upper assembly (22), a fluid intended to expand the various elements against the walls;

wherein, in the region of the upper reinforcing layer (22), at least one additional element (30) is positioned, said additional element being intended to vary the relative position of the mechanization elements of said reinforcing layer (22) with respect to the faces of the ski.

9 Claims, 5 Drawing Sheets

PROCESS FOR THE MANUFACTURE OF A SHAPED SKI

FIELD OF THE INVENTION

The invention relates to a novel process for the manufacture of a shaped ski.

It relates more particularly to an improved process for the manufacture of a ski in a single step, intended to receive various materials, capable of communicating specific properties to the ski; it relates more particularly to an improved process of the type in question, in which it is possible to vary the relative position of the upper reinforcement with respect to the external surface of the ski.

PRIOR ART

In the document U.S. Pat. No. 4,725,070, a process for the manufacture of a ski is described which takes advantage of the thrust obtained in situ by the expansion of the foam during the injection of the reactive compounds intended to form this foam, in order to press against the walls of the mold the various assemblies intended to form the envelope and the sliding surface of the ski.

In the document EP-B-0,430,824, the Applicant has described a process for the manufacture of a shaped ski in a single stage, consisting of a body surrounded by a peripheral envelope produced in two parts, respectively lower and upper parts, which essentially consists:

- in laying down in the bottom of a mold in two parts, respectively a bottom and a cover, a first assembly intended to form the lower envelope forming the sliding surface;
- in positioning, on this lower first assembly, a second, upper assembly intended to form the upper envelope forming the narrow sides and the top;
- in inserting, between the facing faces of these two assemblies, an impermeable layer intended to define a deformable sheath;
- in closing the cover onto the bottom of the mold thus filled;
- in injecting, into this sheath, a fluid intended to expand the two assemblies until they press against the walls of the mold;
- and, finally, in cooling and opening the mold in order to remove the ski thus obtained.

The process advantageously makes it possible to produce, in a single step, a shaped ski, especially when the upper assembly is constituted by a single shell forming a protective and decorative layer.

In order to obtain reliefs on the top of the ski, it has been proposed to vary the thickness of the protective layer at the desired locations. This solution increases the weight of the ski and requires production in several steps.

In order to obtain these same reliefs, in the process of the Applicant described hereinabove, it is possible to provide corresponding cavities in the walls of the cover. Unfortunately, during the thrust, the fibrous reinforcement of the upper envelope undergoes deformations in various directions, in this cavity, which embrittle and often even may lead to the fracture of this fibrous reinforcement, and as a consequence cause an appreciable reduction in the desired mechanical characteristics.

A process has been described in the document FR-A-2,611,519 for manufacturing skis in several separate stages, which consists:

- firstly, in fixing, to the inner face of the cover of a mold, a rigid core, for example a wooden, honeycomb, foam or metal core, intended to form part of the body, and then in placing, on top of a mold bottom matching the cross section of the ski, the upper assembly intended to form the narrow sides and the top, this upper assembly furthermore comprising a plastic filling material capable of flowing into the free spaces in the bottom of the mold upon closing the mold;
- then, in bringing together the cover and the bottom thus filled, so that the rigid mandrel-forming core presses, by thrusting, the assembly against the walls of the mold, while at the same time bringing about the flow of the filling material which thus fills the empty spaces;
- and, finally, in detaching the assembly obtained in order to place it, in a second stage, on a lower assembly, produced beforehand, intended to form the sliding sole.

This technique remains expensive since it requires employing at least two separate stages, namely the manufacture of the body and the joining of it to the sole-forming lower assembly. Furthermore, this technique requires employing a rigid core produced beforehand in order to serve as a mandrel.

In the additional document FR-A-2,620,628, the walls of the bottom of the mold exhibit a hollow or a projection which, upon closing the mold, may be filled in part (see FIG. 14) by an added plate, especially one that is ready made of a viscoelastic material, said plate being inserted prior to the mandrel forming operation between the sheet intended to form the shell and a fibrous reinforcement. However, since this cavity is essentially filled by the thrust effect of the rigid core on an assembly which itself bears against the rigid walls of the mold, the filling of the hollow by the viscoelastic plate is a tricky operation, especially due to the risk of air inclusion or of formation of small cavities, which may generate defects, especially defects of heterogeneity of the ski at this place. The manufacture of these skis is always carried out in several separate steps and therefore remains expensive. Furthermore, although this technique makes it possible to position an added plate in a cavity, it does not make it possible, on the contrary, to position the reinforcing elements inside the ski with respect to the faces of the ski, except by machining the core beforehand and by employing thick filling layers.

The invention overcomes these drawbacks. Its subject is a process for manufacturing a ski in a single molding and forming step, which makes it possible to produce skis, the narrow sides and top of which may exhibit complex shapes, such as reliefs, and the mechanization elements of which may be arranged at desired locations with respect to the faces of the ski in order to obtain specific characteristics.

The subject of the invention is more particularly a single-step process in which the faces of the ski exhibit varied reliefs without the internal fibrous reinforcing elements closely matching the accentuated shapes of these reliefs.

The subject of the invention is also a single-step process for producing a ski, in which the reinforcing elements are positioned with respect to the neutral fiber of the ski in order to obtain appropriate characteristics in predetermined places.

DESCRIPTION OF THE INVENTION

This process for the manufacture of a shaped ski, in a single step simultaneously achieving forming and molding, which consists:

in laying down in the bottom of a mold in two parts, respectively a bottom and a cover, a lower assembly which includes a sliding surface, edges and at least one lower reinforcing layer;

in positioning, on this lower assembly, an upper reinforcing layer composed of mechanization elements;

in placing, on this upper reinforcing layer (22), a protective and decorative layer intended to form the three other faces of the ski, namely at least part of the narrow sides and the top, while at the same time forming a cavity;

in closing the cover onto the bottom of the mold;

in injecting, into the cavity formed between the lower assembly and the upper reinforcing layer, a fluid intended to expand the various elements against the walls of the mold;

and, finally, in cooling and opening the mold in order to remove the ski obtained, is one wherein, in the region of the upper reinforcing layer, at least one additional element is positioned, which additional element is intended to vary the relative position of the mechanization elements of said reinforcing layer with respect to the faces of the ski.

In a preferred embodiment, the invention consists, in a process for manufacturing skis in a single step by thrust effect during the expansion of the filling foam, in arranging, on the walls of the cover and no longer on the bottom of the mold, at least one relief, and then in filling this relief with a plate made of an appropriate material during the progressive expansion of the foam forming the core. As a result, the plate is put into place progressively and accurately, thereby preventing the risk of air inclusion, the formation of small cavities and fracture of the fibrous reinforcing element, and imparts good homogeneity to the assembly.

Advantagously, in practice:

the additional element is laid down between the mechanization layers of the upper reinforcing layer;

the characteristic additional element is laid down on top of the mechanization layers;

the upper face of the ski exhibits a relief defining a cavity on the inner face of the protective layer and the additional element fills up the cavity left between the protective layer and the mechanization layers so as to prevent any breakage of the fibers constituting these fibrous mechanization layers;

this cavity is provided in that inner wall of the cover intended to define the top of the ski, especially just downstream of the part intended to form the tip and upstream of the bearing zone, that is to say in the part where the vibration-damping assembly is generally positioned;

the plate is made of a material chosen from the group comprising rigid plastics, wood, metals, composite materials, commonly used in the manufacture of skis; this may also be a closed envelope containing a fluid (water, oil, air);

the plate is made of a viscoelastic material, possibly combined with a stress plate;

the expansion fluid is air or a wetting or non-wetting bonding resin;

the expansion fluid is constituted by a mixture of reactants intended to form, in situ, a plastic filling foam, especially a polyurethane or polyester foam, so that the assembly, contrary to the prior art identified in the preamble, no longer includes a rigid core;

the protective and decorative layer is a single shell closely matching the shape of the ski.

In a practical embodiment, the top of the ski exhibits a relief defining an internal cavity, and this cavity is filled up by the characteristic plate formed by a damping assembly constituted by a rigid stress plate exhibiting an elastic modulus E greater than 10,000 MPa and having a thickness of between 0.5 and three millimeters, preferably of the order of one millimeter; as rigid plate having a high elastic modulus, aluminum alloys, aluminum/zinc/magnesium alloys, especially of the type of those which are marketed by the Company CEGEDUR-PECHINEY under the registered trademark "ZICRAL", or laminated thermosetting materials or glass-fiber or carbon-fiber reinforced thermoplastics may advantageously be used. This stress plate is combined with a layer made of a viscoelastic material having a thickness of between 0.5 and two millimeters, preferably approximately one millimeter, commonly used in the manufacture of skis, for example butyl rubber, or a synthetic elastomer, by itself, or as a mixture or filled. Thus, the stress plate and the viscoelastic layer exhibit optimum damping effects, thereby not making it possible to obtain a construction illustrated in FIG. 14 of the document FR-A-2,620,628 cited in the preamble.

The characteristic relief of the invention may be arranged equally well on the narrow sides of the ski as on the top of the ski. Advantageously, it is positioned at a vibration antinode, especially just downstream of the tip and upstream of the bearing zone. It is also possible to position this relief right at the center of the zone of the runner, so as to give additional thickness in this sector.

In a practical embodiment, an impermeable flexible membrane, such as, for example, a sheath made of a stretchable plastic, is inserted, just before injection, between the two, respectively lower and upper, fibrous elements, into which the fluid intended to push these elements against the walls of the mold is injected.

BRIEF DESCRIPTION OF THE DRAWINGS

The manner in which the invention may be carried out and the advantages which stem therefrom will emerge more clearly from the embodiment example which follows, with reference to the appended figures.

MANNER OF CARRYING OUT THE INVENTION

Figure 1:
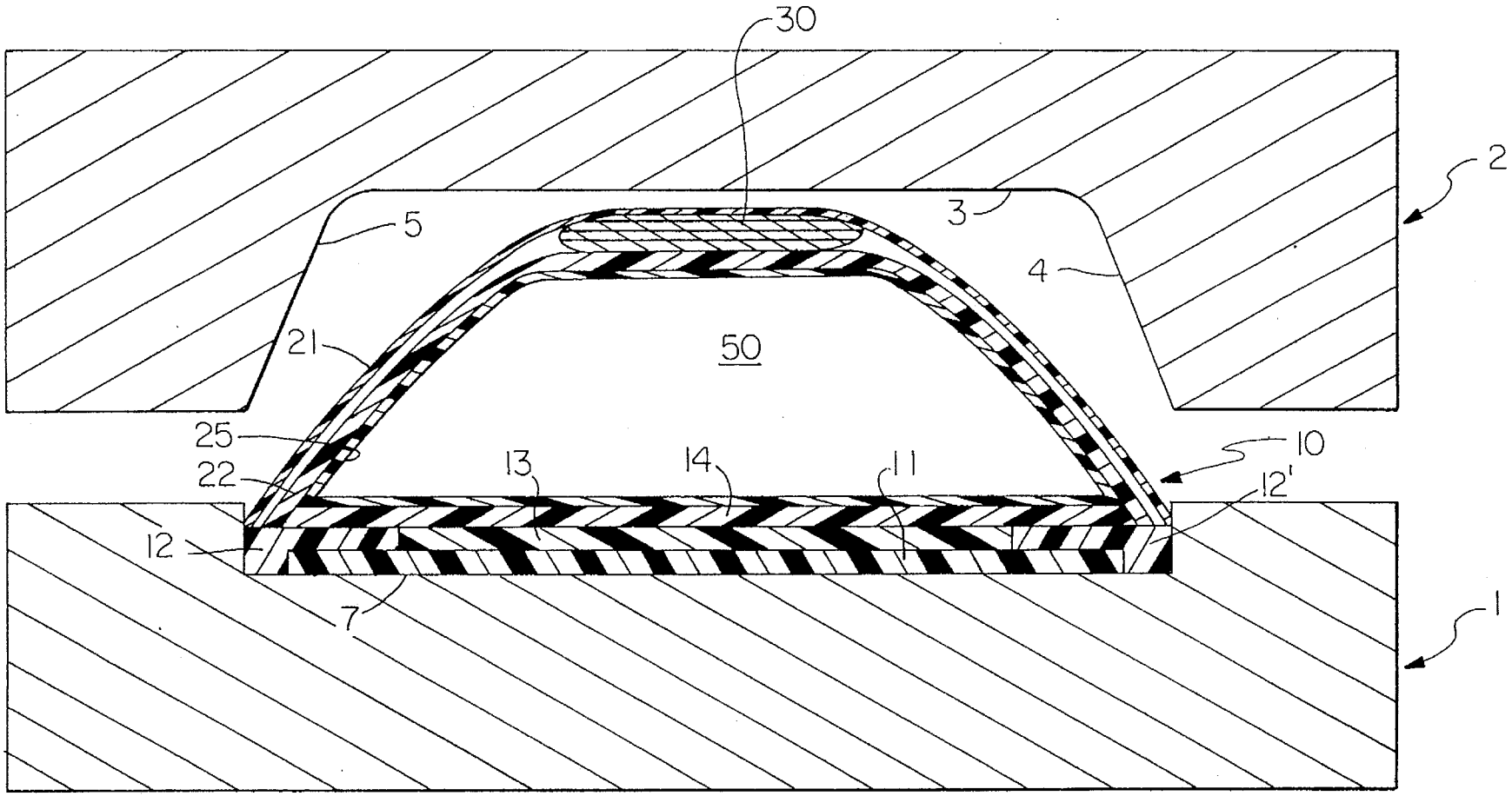
FIG. 1 is a diagrammatic sectional representation of a mold, depicted in the open position, equipped in accordance with the invention.
Figure 2:
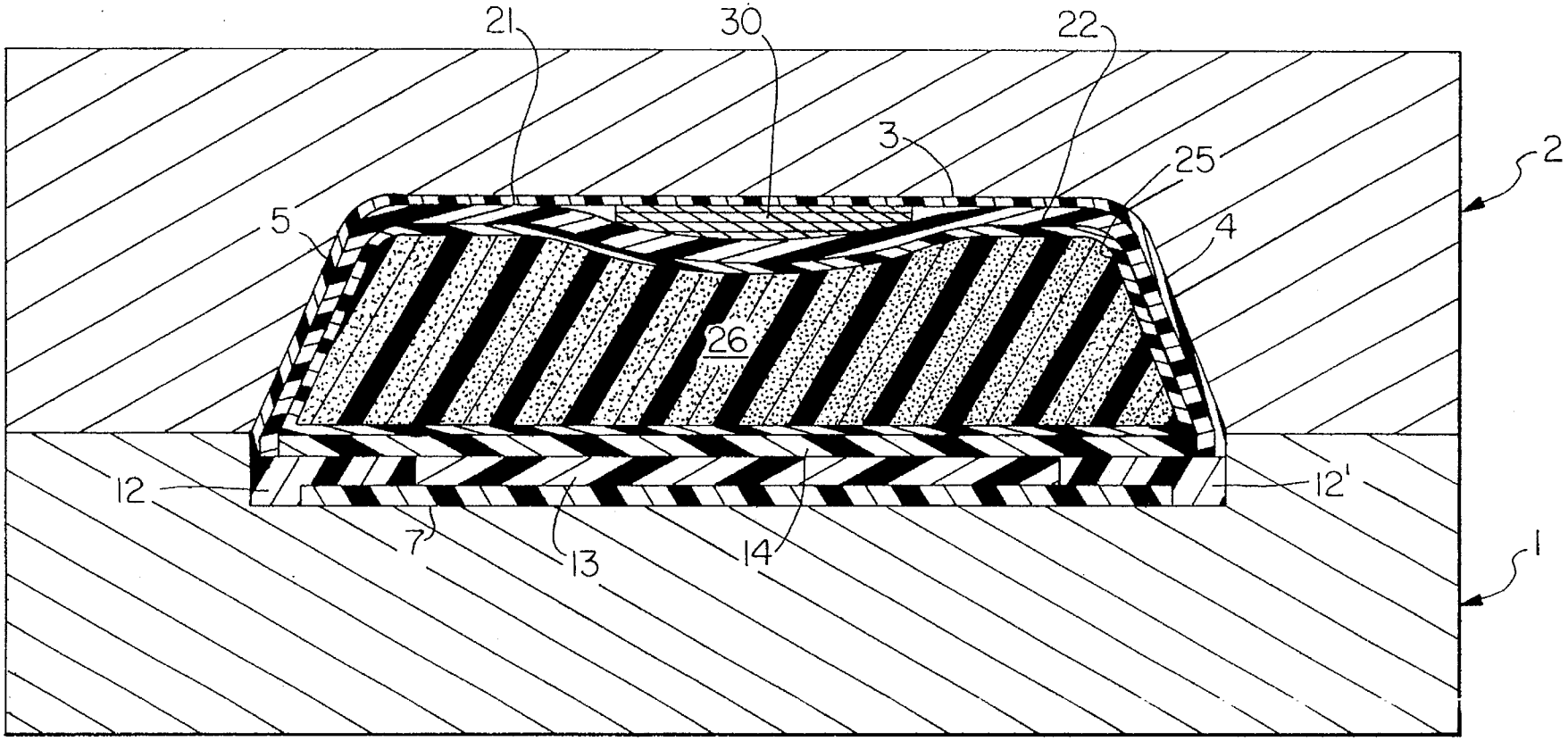
FIG. 2 is a diagrammatic representation of the same mold in the closed position.

The mold comprises (see FIGS. 1 and 2) two parts, respectively a bottom (1) and a cover (2), the inclined side walls (4, 5) of which are intended to form the narrow sides, and the horizontal upper wall (3) of which forms the top of the ski.

The bottom (1) exhibits a housing (7) intended to receive a first assembly (10) intended to form the lower assembly forming the sliding surface. This assembly comprises the actual sole (11), the two edges (12 and 12') and lower fibrous reinforcing elements (13), respectively (13 and 14), preimpregnated with a thermosetting resin, for example an epoxy resin. As taught by the document EP-B-0,430,824 of the Applicant cited in the preamble, a second assembly is positioned on this lower first assembly (10), said second assembly being intended to form the upper envelope and comprising, in order:

an upper reinforcing fibrous material (22), consisting of a textile web preimpregnated with a thermosetting resin, for example an epoxy;

a thermoplastic protective shell (21), for example made of an ABS resin, exhibiting a decoration on the outside.

An impermeable sheath, designated by the reference (25), which is tubular, made of stretchable plastic and laid down flat on the lower assembly (10), is inserted into the space forming the cavity (50) delimited by the two, lower (14) and upper (22), reinforcements.

According to one characteristic of the invention, an additional plate (30) is positioned on the top of the upper fibrous reinforcing element (22), said additional plate being fastened, in a temporary or non-temporary manner by known means, such as stitching, bonding or other means. This rigid plate (30), for example made of metal, closely matches (see the figures) the shape of a half moon, so as to prevent abrupt deformation of the fibers of the fibrous reinforcing material (22), which abrupt deformation being known to cause fracture of the fibers and, as a consequence, deterioration of the mechanical properties.

Once all these elements are in place, the mold is closed (FIG. 2), and then the constituents of a polyurethane foam, namely an isocyanate and a polyol are injected into the sheath (25). In a known manner, these components react together and expand in situ, bringing about the progressive pressing of the upper assembly against the walls (3, 4, 5) while at the same time bringing about the adhesion of the various constituents to each other and to the foam (26) thus formed. During the expansion, the characteristic plate (30) is then progressively put into place against the inner face of the shell (21) which itself bears against the inner face of the top (3) of the cover (2). In this way, the upper fibrous reinforcement (22) is put into place in the desired position with respect to the top of the ski.

Thus, by virtue of the curvature of the inner face of the additional element (30) and of its dimensions, it is possible to modify the relative positioning of the upper reinforcement (22) of the ski both with respect to the top of the ski and, especially, with respect to its neutral fiber.

Figure 3:
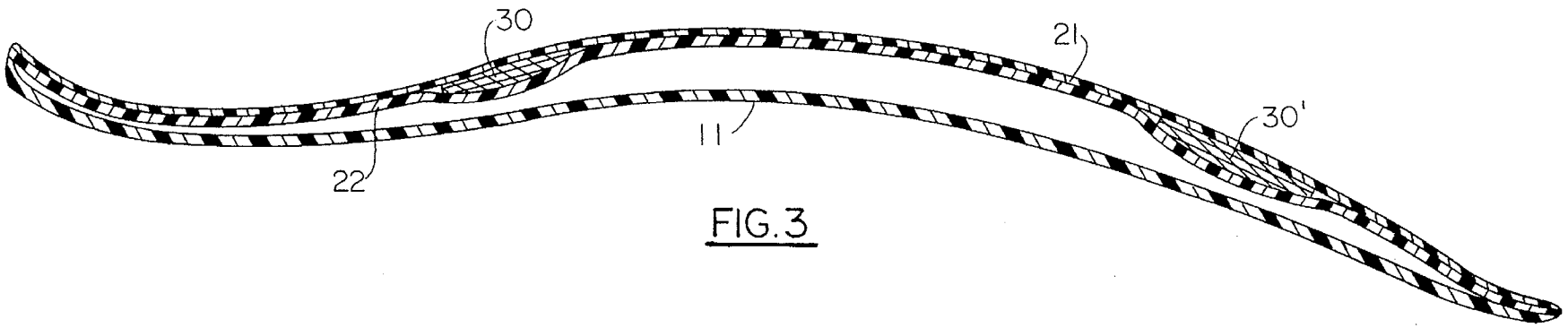
FIG. 3 is a longitudinal sectional representation of a ski in accordance with the invention.

In an advantageous shape shown in FIG. 3, this rigid additional element is localized longitudinally in the tip zone (30) and/or the ski-heel zone (30') in order to modify the flexibility of the ski.

Figure 4:
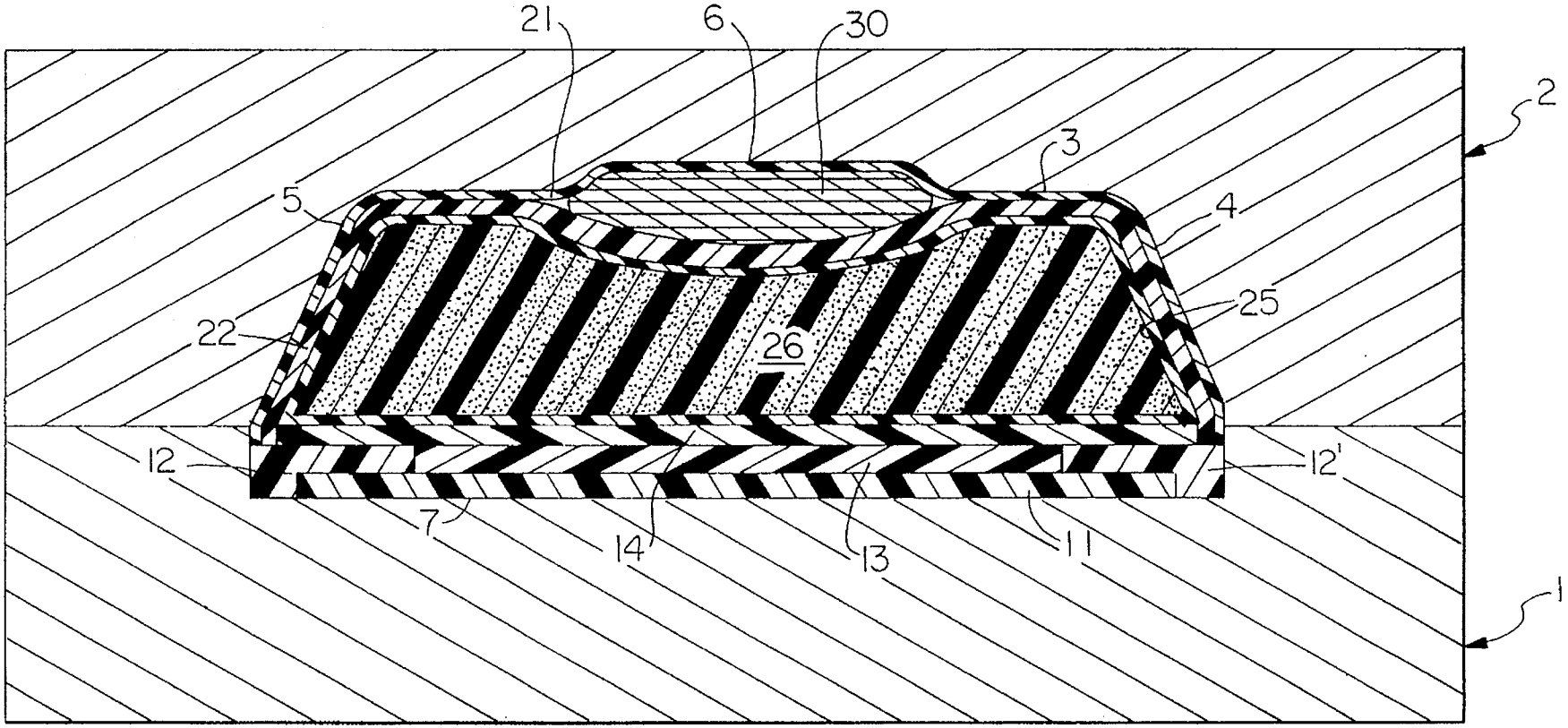
FIG. 4 is an improved embodiment of a mold in the closed position, in accordance with a preferred mode of the invention (with a cavity).

In an advantageous embodiment shown in FIG. 4, the horizontal inner wall (3) of the cover (2) exhibits a cavity designated by the reference (6). During the expansion, the characteristic plate (30) is then progressively installed in the cavity (6) until completely filling it, since its shape and its positioning on the fibrous reinforcing element (2) correspond exactly to those of said cavity (6). Moreover, once in place, this additional element (30) modifies locally, as previously, the relative position of the upper reinforcement (22) with respect to the neutral fiber.

Figure 5:
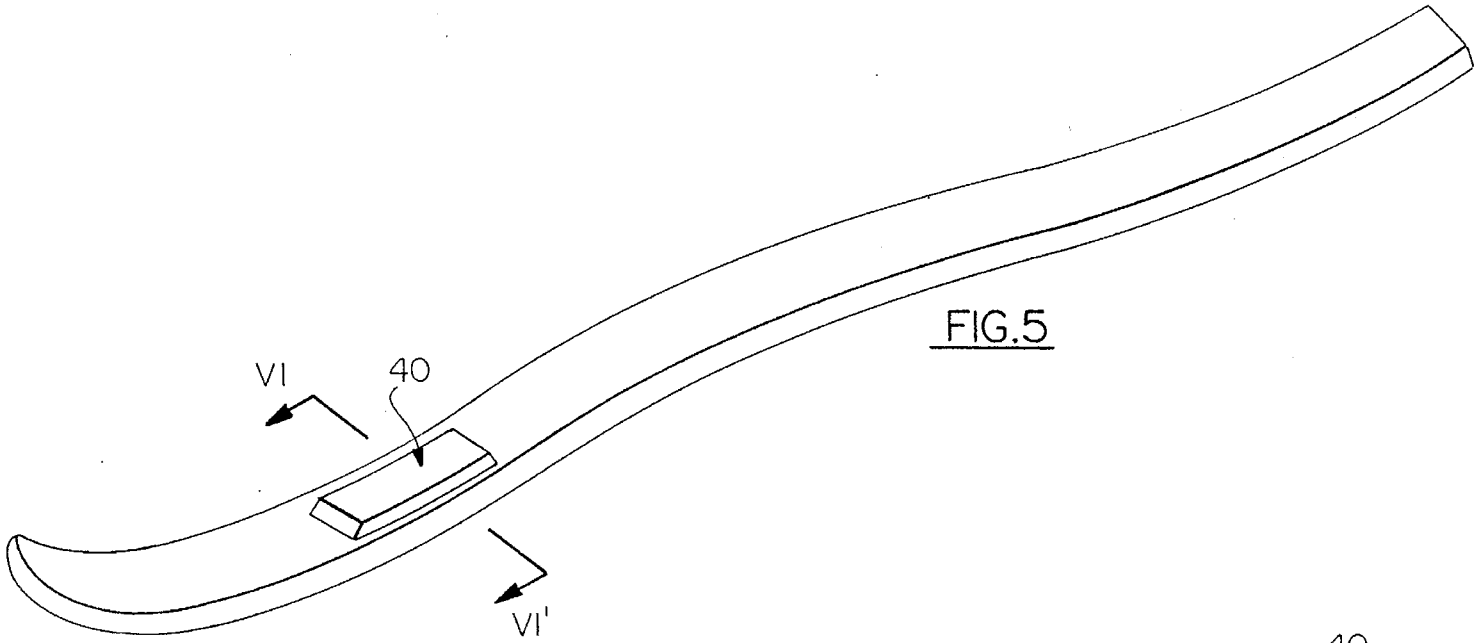
FIG. 5 is a diagrammatic representation, in summary perspective, of a ski in accordance with one mode of the invention, shown in section in FIG. 6 along the axis VI–VI' of FIG. 5.
Figure 6:
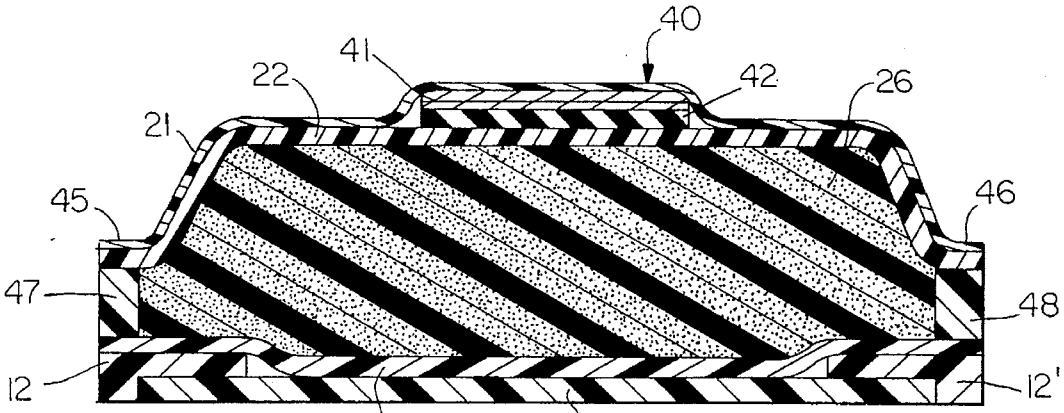

In a particular embodiment illustrated in FIGS. 5 and 6, the plate for filling the cavity (6) forming the relief (40) is constituted by a damper assembly formed on the top in contact with the inner part of the relief (40) of a stress plate (41) such as one made, for example, of an aluminum/zinc/magnesium alloy marketed by CEGEDUR/PECHINEY under the trademark "ZICRAL", exhibiting an elastic modulus of 12,000 MPa and a thickness of one millimeter.

This stress plate (41) is combined with a sheet (42) having a high damping coefficient, the two, respectively inner and outer, faces of which have been coated beforehand with an adhesive layer in order to promote fastening to the stress plate (41) and to the fibrous reinforcing element (22). This viscoelastic sheet (42) made of butyl rubber exhibits a thickness of one millimeter and a damping coefficient at 25° C. of between 0.4 and 1.2, preferably 0.6 and 0.8.

This arrangement makes it simpler for putting the damping element in place, said damping element thus being no longer attached to the top of the ski, as is described in the document FR-A-2,611,519 of the Applicant, but is integrated into the ski.

In the embodiment illustrated in FIG. 6, the shell (21) exhibits curved lateral edgings (45, 46). These edgings, arranged parallel to the sole (11), bear on the end of the upper reinforcing element (22) and this assembly in turn bears on narrow sides (47, 48) made of rigid plastic. These narrow sides (47, 48) rest on the edgings of the lower element of the ski, and more precisely on the lower reinforcement (13, 14) bearing on the edges (12, 12').

The skis in accordance with the invention exhibit numerous advantages with respect to those known, and especially to those cited in the preamble. Mention may be made of:

the simplification of the manufacture, since a single-stage operation is performed;

the possibility of communicating specific properties to defined places, while at the same time providing the substantially linear arrangement of the fibrous reinforcements, thereby preventing causes of fracture.

I claim:

1. A process for the manufacture of a shaped ski in a single step which includes simultaneously forming and molding, said process comprises:

positioning a mold containing a bottom part and a cover part, said parts having contoured wall surfaces defining the shape of the bottom, sides and top of the ski;

laying down a lower assembly in the bottom part of the mold, said lower assembly having a sliding surface, edges and at least one lower reinforcing element;

positioning an upper fibrous supple rainforcing layer on said lower assembly thereby forming a cavity between the lower assembly and the upper fibrous reinforcing layer;

placing a protective and decorative layer on said upper fibrous supple reinforcing layer, said protective and decorative layer forming at least part of narrow side faces and a top face of the ski;

positioning locally at least one rigid additional element between the upper fibrous supple reinforcement layer and the protective and decorative layer whereby the placement of said rigid additional element controls the relative position of said upper fibrous supple reinforcing layer with respect to the faces of the ski, said rigid additional element having the general shape of a half moon having a curvature side, the curvature side of said rigid additional element being directed towards the lower assembly;

closing the cover pan of the mold onto the bottom part of the mold;

injecting into said cavity constituents of a foam, said constituents expanding and thereby press, the upper fibrous supple reinforcement layer, the rigid additional element, the protective and decorative layer and the lower assembly against the contoured wall surfaces of the mold parts, whereby the orientation of the curvature side of the half moon shape of the rigid additional element prevents the abrupt deformation of the upper fibrous supple reinforcing layer;

cooling and opening the mold in order to remove the shaped ski.

2. The process as claimed in claim 1, wherein the rigid additional clement is positioned within the upper fibrous supple reinforcing layer.

3. The process as claimed in claim 1, wherein the rigid additional element is laid down on top of the upper fibrous supple reinforcing layer.

4. The process as claimed in claim 1, wherein the protective and decorative layer is a single thermoplastic shell closely matching the shape of the ski.

5. The process as claimed in claim 1, wherein the top face of the ski exhibits a relief defined by a second cavity on the inner surface of the protective and decorative layer, said rigid additional element filling up the second cavity.

6. The process as claimed in claim 5, wherein said ski has a tip and a bearing zone and wherein a third cavity is provided in the contoured wall surface of the cover part of the mold, said third cavity being located downstream of the ski tip and upstream of the bearing zone where a vibration-damping assembly is positioned, the position of the second cavity containing said rigid additional element coinciding with the position of the third cavity.

7. The process as claimed in claim 1, wherein the rigid additional element is made of a material selected from the group consisting of plastic, wood, metal, composite material and viscoelastic material.

8. The process as claimed in claim 1, wherein the rigid additional element consists of a stress plate combined with a sheet made of a viscoelastic material.

9. The process as claimed in claim 1 wherein, after the step of laying down the lower assembly in the bottom part of the mold and before the step of positioning the upper fibrous supple reinforcing layer on the lower assembly, narrow rigid sides are positioned between the edges of the upper fibrous supple reinforcing layer and the lower assembly.

* * * * *